United States Patent [19]

Wells et al.

[11] 4,014,150

[45] Mar. 29, 1977

[54] INSULATION SYSTEM FOR BUILDING STRUCTURES

[75] Inventors: David Lee Wells, Adrian, Mich.; Ronald Buxton Raab, Perrysburg, Ohio

[73] Assignee: Johns-Manville Corporation, Denver, Colo.

[22] Filed: Dec. 19, 1975

[21] Appl. No.: 642,507

[52] U.S. Cl. ..... 52/461; 52/495; 52/716

[51] Int. Cl.[2] ..... E04C 1/34

[58] Field of Search ..... 52/461, 404, 463, 727, 52/732, 480, 495, 467, 729, 716

[56] References Cited

UNITED STATES PATENTS

| | | | |
|---|---|---|---|
| 3,513,614 | 5/1970 | Studzinski | 52/404 |
| 3,594,972 | 7/1971 | Jones | 52/716 |

*Primary Examiner*—John E. Murtagh
*Attorney, Agent, or Firm*—Robert M. Krone; Joseph J. Kelly; John H. Miller

[57] ABSTRACT

Building structures, such as pre-engineered metal buildings, concrete buildings, and combination concrete and metal buildings in most areas require insulation due to the relatively high thermal conductance of the metal and concrete components in the buildings walls and roof. Because of energy conservation measures brought on by fuel shortages and rapidly rising fuel costs, insulation systems used in the past are generally not adequate to meet more stringent standards either recently established or planned for the near future. The present invention provides an improved insulation system for use in either new construction or in reinsulating existing building structures. The insulation system of the present invention insulates the areas of the wall or roof between the structural members, and also isolates the structural members with insulation from the outer covering, whether it be roof sheets or wall panels, and from the interior of the building itself to significantly reduce the heat loss experienced through the structural members in conventional insulation systems.

7 Claims, 9 Drawing Figures

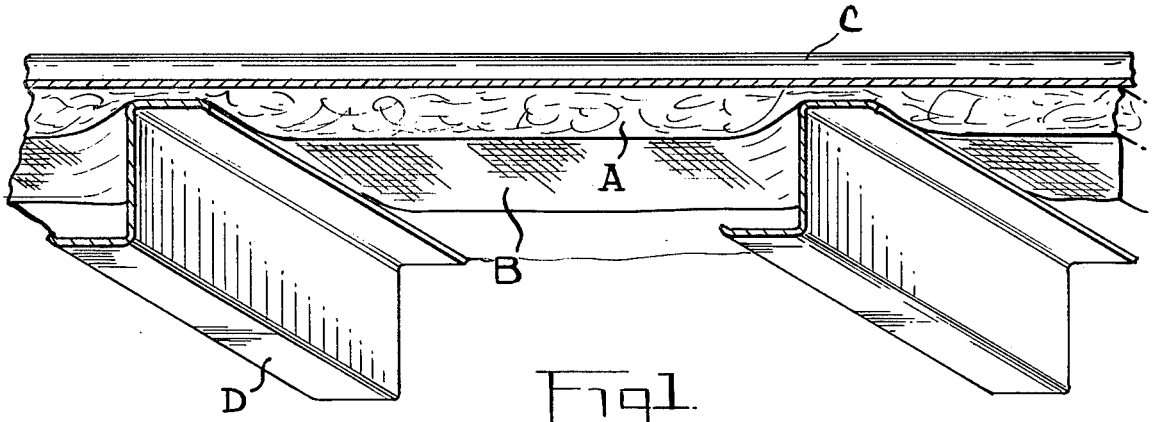
Fig. 1.
PRIOR ART
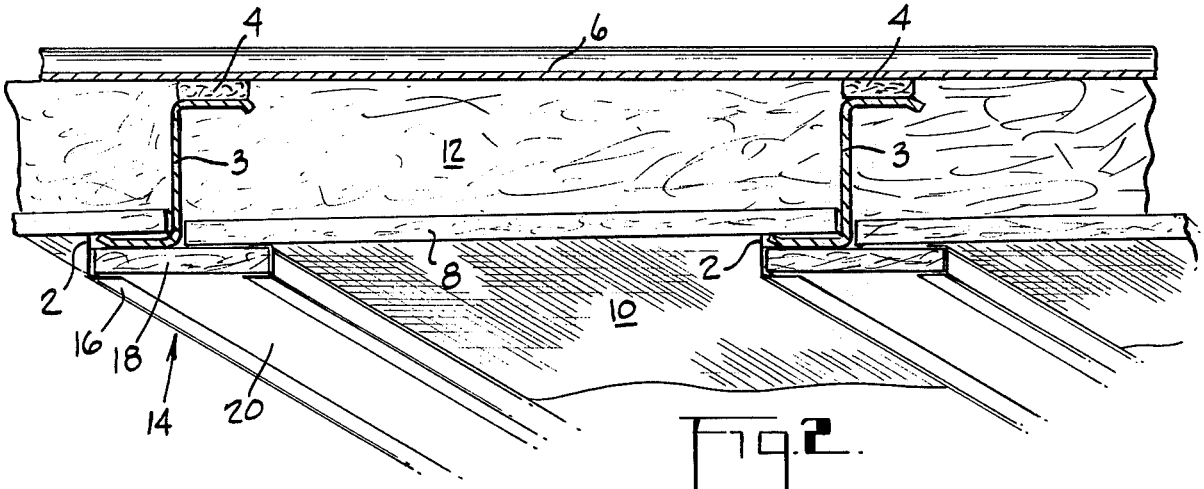
Fig. 2.
Fig. 3.
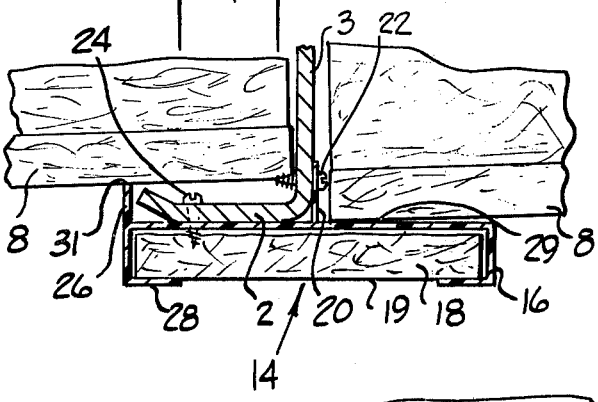
Fig. 4.
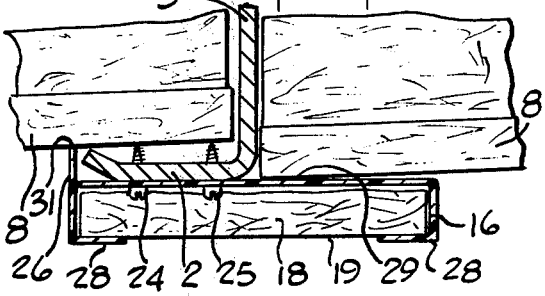
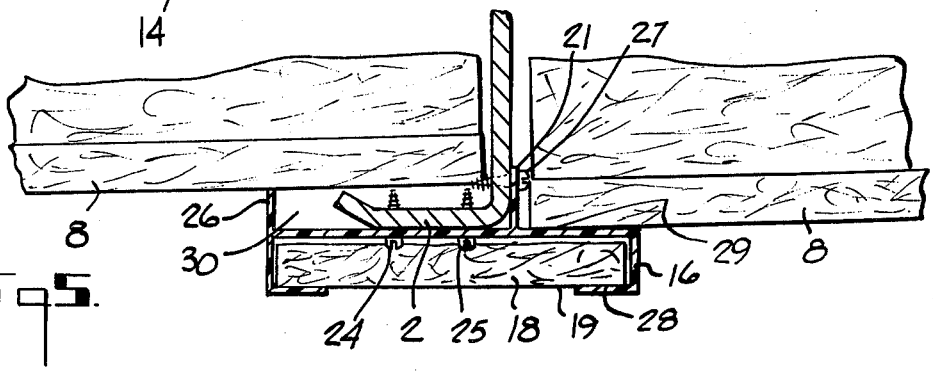
Fig. 5.

Fig. 6.
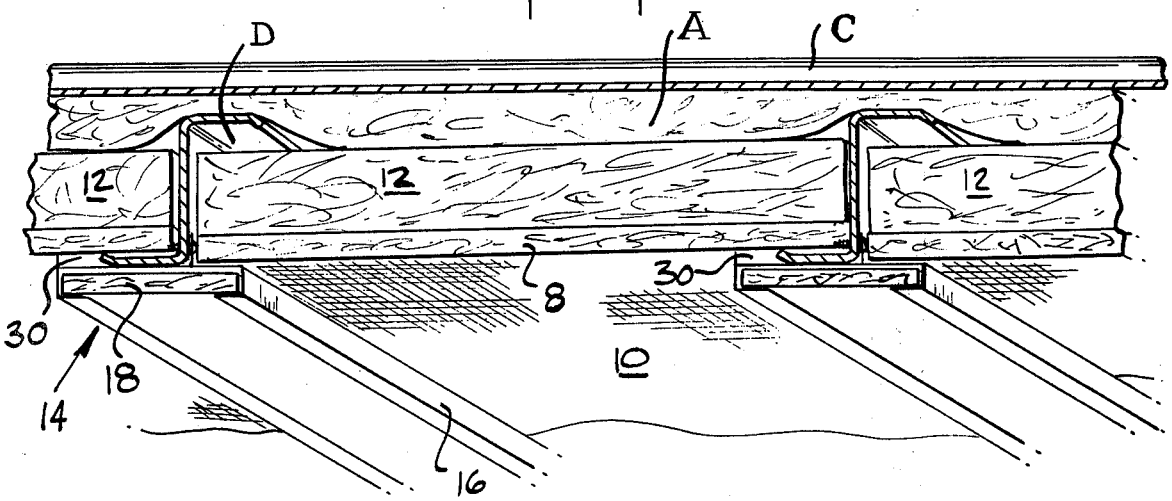
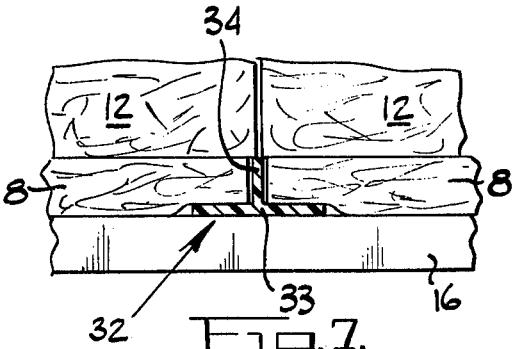
Fig. 7.
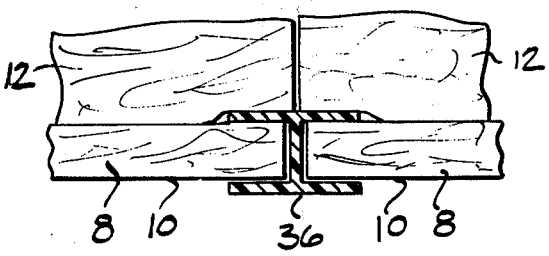
Fig. 8.
Fig. 9.
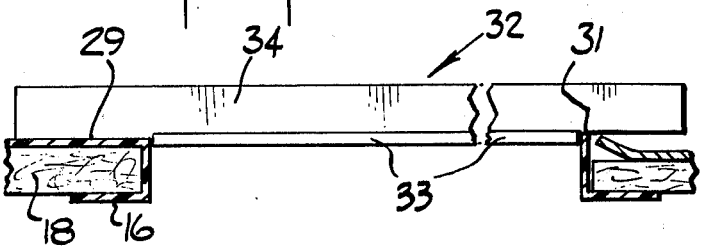

INSULATION SYSTEM FOR BUILDING STRUCTURES

The present invention relates to an insulation system that isolates most or all of the structural members in a building from the interior of the building and from the material covering the structural members on the exterior side of the building .

BACKGROUND OF THE INVENTION

In the past, building structures such as metal buildings or buildings with concrete structural members, or buildings with combinations of concrete and metal structural members have been insulated in many ways. For example, fiber glass blanket insulation has been put between the structural members and held in place with such things as metal straps, chicken wire, etc. Rigid or semi-rigid boards of felted fibers such as fiber glass have also been used for insulating metal and concrete buildings, but no attempt was made to isolate the structural members from the interior of the building and such rigid or semi-rigid boards do not provide sufficient insulation to meet the newly emerging standards.

Another insulating system used extensively, particularly in metal buildings, is shown in FIG. 1 and is described in detail in U.S. applications Ser. Nos. 588,734 and Ser. No. 591,584, both filed in June, 1975 and assigned to Johns-Manville Corporation, assignee of the present application. This insulation product, known in the trade as RIGID-ROLL, comprises a layer of bonded glass fibers A which is flexible, but yet board-like in that it tends to return to a board-like product after being bent and released. The layer of bonded glass fibers is faced with a vapor barrier facing B such as a vinyl facing. The facing, along a longitudinal edge, extends beyond the layer of bonded glass fibers to form a tab (not shown). The tab is reinforced such that when the strips of RIGID-ROLL are butted together so that the tab overlies the adjacent strip, the tab forms a vapor barrier seal between adjacent strips when the metal roof sheets C are fastened against the structural members, or purlins D. While such an insulation system is easy to install and offers many advantages over other systems, compression of the fibrous layer between the outer sheets C and the structural members D seriously reduces the insulating value of the insulation at those areas. As a result, such a system alone will not meet the high insulating standards required by either specifications or by economics for many areas of the country.

The object of the present invention is to provide an insulation system which can be used in new construction or in the reinsulation of old construction, that can be used either alone or in conjunction with prior art insulation systems of the type shown in FIG. 1, and that will provide a more efficient insulation system for the types of buildings described above by insulating and isolating all or most of the structural members of the building from the differing temperatures of the interior and the exterior of the building.

BRIEF SUMMARY OF THE INVENTION

The present invention provides an insulation system for a building structure having structural members and a covering material spanning the structural members on the exterior side, both having a relatively high coefficient of thermal conductivity, comprising:

a. a first insulation means for isolating the covering material from the structural members, the first insulation means being located between the structural members and the covering material and having a relatively low coefficient of thermal conductivity, b. a second insulation means in the form of a board-like sheet or layer of material spanning between adjacent structural members, opposite edges of said second insulation being at least near a structural member, said second insulation means having a relatively low coefficient of thermal conductivity, c. a third insulation means located between the second insulation means and the covering material and having a higher insulating value than the second insulation means, and d. a fourth insulation means of a configuration and location to insulate and isolate completely at least most of the structural members from the interior of the building. The fourth insulation means also acts as a support for one edge of the second insulation means. In the preferred embodiment the fourth insulation means comprises a rigid means such as an extruded plastic channel-like member for holding one or more strips of insulation material. Preferably, the channel-like member is fastened to the structural members and is of such a configuration as to support the second insulation means on both sides of the structural member in a vapor sealing manner.

BRIEF DESCRIPTION OF THE DRAWINGS

FIG. 1 is a cross-section of a perspective view of a typical prior art insulation system.

FIG. 2 is a cross-section of a perspective view of an insulation system of the present invention.

FIG. 3 is an enlarged cross-section of a portion of one embodiment of the present invention.

FIG. 4 is an enlarged cross-section of a portion of another embodiment of the present invention.

FIG. 5 is an enlarged cross-section of a portion of still another embodiment of the present invention.

FIG. 6 is a cross-section of a perspective view of the present invention used with a prior art insulation system of the type shown in FIG. 1.

FIGS. 7 and 8 show two ways of providing vapor barrier seals at joints in the insulation system of the present invention.

FIG. 9 is a partial view of a joint in the insulation system of the present invention.

DETAILED DESCRIPTION AND PREFERRED EMBODIMENTS

Commercial and industrial buildings are frequently of the type shown in U.S. Pat. No. 3,121,649 and comprise metal or concrete structural members with an outer covering of a material such as corrugated metal, concrete panels, etc. Both metal and concrete have a relatively high coefficient of thermal conductivity compared to wood and thermal insulating materials and therefore it is usually desirable, and sometimes essential, that these buildings be insulated with a material having a relatively low coefficient of thermal conductivity to reduce the rate of heat flow either into or out of the building. A coefficient of thermal conductivity of about 1.5 BTU/sq.ft./in./hr./°F or less is a relatively low coefficient of thermal conductivity for purposes of defining the terminology used herein. Since the structural members themselves represent channels for substantial heat flow through the walls, insulation systems which do not isolate all or most of the structural members from both the interior of the building and from the covering spanning the structural members on the exterior side of the structural members permit excessive heat flow through the structural members.

Referring to FIG. 2, the insulation system of the present invention insulates and isolates structural members 2, which in this case are metal purlins spanning between conventional supporting columns (not shown). The insulation system of the present invention comprises a first insulation means 4 located between the purlins 2 and a covering material spanning the purlins on the exterior side, which in the present case is a corrugated metal sheet 6. The first insulation means 4 can be a strip of glass fiber blanket or board, strips of foamed plastic material, narrow pieces of wood, or any other material having a relatively low coefficient of thermal conductivity, compared with the thermal conductance of the structural members and the covering material 6. As will be seen later, the first insulation means 4 can be a continuous strip of insulation material, such as the RIGID-ROLL product previously described.

The system of the present invention also comprises a second insulation means 8 which spans between, or almost spans between, the purlins 2. Preferably, the second insulation means 8 is dimensioned such that its width is just slightly less than the distance between the two purlins 2. The second insulation means should be sufficiently rigid such that it will span the distance between two adjacent purlins 2 without sagging or bowing excessively, e.g. less than 1 inch bow or sag between two adjacent structural members which usually are spaced 5 feet apart or less. In the preferred embodiment, the second insulation means comprises a blanket of bonded glass fibers having a density of about 1.75 to 2.5 pounds per cubic foot or more, most perferably about 2–2.25 PCF. The interior surface 10 of the second insulation means should be coated or faced with a material that will provide a vapor barrier, such as a conventional vinyl facing. This coating or facing 10 can also serve to provide a pleasing appearance to the interior of the building. The second insulation means has a relatively low coefficient of thermal conductance. For example, in the preferred embodiment the second insulation means is a vinyl faced glass fiber insulation board about 1½ inches thick having an insulating value (R-value), as determined by ASTM C236-66, of about 6.

A third insulation means 12 is provided between the second insulation means 8 and the covering material 6. Any suitable insulating material having a high insulating value is suitable as the third insulation means, e.g., blankets or clumps of glass fibers, raw wool, or equivalents. For ease of installation, it is preferred to use batts or continuous strips of bonded glass fibers or mineral wool having an R-value of R-5 or above, preferably an R-19 or above value.

The fourth insulation means 14 serves to support the second insulation means 8 on either side of a web 3 of the purlins 2 at locations 29 and 31 and, most importantly, to insulate and isolate the purlins 2 from the interior of the building. The fourth insulation means can be a single piece of insulation material of an appropriate shape that will be defined in detail later, but preferably comprises a strip of insulating material 18, e.g., preferably a similar nature to the second insulation means 8 and the facing 10, and a holding means 16 which is fastened to each of the purlins 2 and holds the insulation 18 in place.

One embodiment of the fourth insulation means is shown enlarged in FIG. 3. In this embodiment, the insulation holding means 16 is an elongated member, preferably of extruded plastic material having the same or similar color as the facing 10, being generally of C-shaped configuration having two shelf-like members 28 for retaining the layer of insulation 18. The insulation retaining member 16 of this embodiment also has two extension members 20 and 26 integral with and protruding above its largest surface and running along the entire length of the member 16. The first extension member 20, which is optional, has a first function of properly locating the member 16 with respect to the structural member 2 and an optional second function of providing support by way of a conventional fastening means 22 to each of the purlins 2, for the member 16. The second extension member 26 protrudes sufficiently to extend beyond any portion of the purlin 2 in the direction of the second insulation means 8 such that the second insulation means 8 and its facing 10 rest on an upper face 31 of the extension member 26 forming a vapor seal between member 16 and the second insulation means 8. This seal at the upper face 31, the extension of member 16 completely across a lower face of the structural member, and a seal at 29 insures that the structural member is completely insulated from the interior of the building. Member 16 is also attached to the structural member by conventional fastening means 24, such as metal screws, self-threading screws, bolts, rivets, etc. with or without washers for additional support.

The fourth insulation means in the embodiments shown here also comprises a layer of insulation 18 having a facing 19 identical or similar to facing 10. The insulation 18 can be of any suitable conventional type that does not bow excessively upon spanning between the two shelf-like members 28. In a typical embodiment, the layer of insulation 18 can be about 1½inches thick and can have density ranging from about 0.4 to 2 PCF or more. The facing 19 can be a painted coating vinyl film adhesively secured to the layer 18. The insulating strip 18 and its facing 19 can be inserted into the retaining member 16 by sliding the insulation into one end and along the length thereof or by first inserting one longitudinal edge of the insulating layer above one of the shelf-like members 28 and then flexing the strip of insulation 18 to insert the opposite edge above the opposite shelf-like member 28 and finally pushing the center portion of the layer 18 upwardly until the layer is properly in place. The fourth insulation means should have an R-value of at least 6.

A slightly different embodiment of the fourth insulation means is shown in FIG. 4. The insulation retaining member 16 differs from the embodiment shown in FIG. 3 in that the second protruding member 20 has been eliminated and a second fastening means 25 has been added to adequately support the member 16 on the purlin 2.

A still further embodiment is shown in FIG. 5. In this embodiment a second protruding member 21, similar to member 20 in FIG. 3, but spaced at a greater distance from member 26, is located on the insulation retaining member 16. Member 21 can act as a hanger by using a conventional fastening means 27 to secure it to the web 3 of the purlin 2, but its primary function is to ensure that the protruding member 26 will be located at a spaced distance from the extremity of the purlin 2. By locating the insulation retaining member 16 in the manner shown in FIG. 5, a space 30 is provided between the protruding member 26 and the purlin 2. Since the thermal conductivity of the material used to make the member 16 and the protruding member 26, usually a metal or an extruded plastic, is much higher than the insulating materials 18, 8, and 12, a configuration such as shown in FIGS. 2–4 will permit heat to escape the building via the member 26 and the structural member 2. Preferably, this is avoided by the configuration shown in FIG. 5. Simply spacing the protruding member 26 from the extremity of the purlin 2 reduces the heat loss substantially, and still further heat loss can be avoided by placing a narrow strip of insulating material in the space 30. This can be accomplished by adhering a strip of fiber glass insulation such that it is in contact with one surface of the member 26 and a portion of the largest surface of the member 16 prior to installing the member 16 in the position shown in FIG. 5. The thickness of the insulating strip should not be such as to significantly extend above the protruding member 26.

In the previous figures the present invention has been shown as an insulation system of the type that would be installed in new construction or in reinsulating a building having no previous insulation. The present invention can also be used to reinsulate existing buildings which were initially insulted, e.g., with blanket insulation such as the RIGID-ROLL shown in FIG. 1. Such a combination is illustrated in FIG. 6 with the various elements identified in the same manner as in FIGS. 1 and 2. In such an embodiment, the third insulation means 12 can be of less thickness than in the system shown in FIG. 2 because the existing insulation layer A provides a portion of the third insulation means.

An insulation system of the type shown in FIG. 6 wherein A is a 2.5 inch thick RIGID-ROLL material (vinyl faced fiber glass insulation having a density of about 1 PCF), the second insulation means 8 is a vinyl faced glass fiber board having a density of about 2.2 PCF and a thickness of about 1.5 inches, the third insulaton means is a glass fiber blanket 5 inches thick and having a density of about 0.4 PCF, and the fourth insulation means is an extruded PVC plastic having a wall thickness of 0.06 inches placed as in FIG. 4 and containing the same insulation and of the same thickness as the second insulation means has an R-value of about 23–24. An insulation system as that shown in FIG. 1 wherein A is a 2.5 inch thick RIGID-ROLL material has an R-value of only about 8.

Frequently the structural members 2 are longer than the second insulation means 8. When this occurs it is necessary to use more than one panel of the second insulation means 8 resulting in a joint between the two adjacent panels. FIGS. 7 and 8 show two suitable methods of providing a vapor barrier seal at these joints. In FIG. 7 an elongated T-shaped member 32, preferably of extruded plastic, or fabricated or rolled metal, is shown with the T spanning and the bottom 33 of each end of the T 32 resting on insulation retaining members 16 attached to adjacent structural members with the leg of the T 34 extending into the joint between the two panels 8. Preferably, those portions of the bottom 33 of the T 32 that would rest on the surfaces 31 and 29 of the member 16 are removed, as shown in FIG. 9, to provide a better vapor seal between the second insulation means and the surfaces 31 and 29.

FIG. 8 shows a system in which an H-shaped member 36 is used to provide a vapor barrier at the joint between two adjacent panels 8. The H-shaped member 36 can be of the same material as the T shaped member in FIG. 7. A good seal is ensured if the combination of the thickness of the layer 8 and the facing 10 is slightly thicker than the opening in the H-shaped member such that the layer 8 must be slightly compressed in order to insert the layer into the opening in H-shaped member 36.

In all of the embodiments shown, it is preferred that the third insulation means 12 be of sufficient thickness that it must be compressed somewhat when the second insulation means 8 is put into the position shown in the figures. The slightly compressed third insulation means will apply a downward force against the second insulation means improving the vapor barrier seal at locations 29 and 31 and also between the T shaped member 32 and the panels 8 in FIG. 7 and the H-shaped member 36 and the panels 8 in FIG. 8. These vapor barrier seals are important because the structural members will be significantly cooler, particularly when the exterior temperature is significantly below normal, than the interior of the building. If warm air from the interior of the building is permitted to flow up around the structural members, the cooler structural members will cool this warmer air leaving water condensation on the structural members. Such a result is undesirable and can damage both the structural members and the insulation system. Adhesives or pressure sensitive tapes can be used in the vapor sealing areas previously described, but this is not usually necessary in the system of the present invention and therefore would in most cases needlessly add to the cost of the installation.

In describing the invention certain embodiments have been used to illustrate the invention and the practice thereof. However, the invention is not limited to these specific embodiments as other embodiments and modifications within the spirit of the invention will readily occur to those skilled in the art on reading this specification. The invention is thus not intended to be limited to the specific embodiments disclosed, but instead is to be limited only by the claims appended hereto.

What we claim is:

1. An insulation system for a building structure having structural members and a covering material spanning the exterior portions of said structural members, both having a relatively high coefficient of thermal conductance, comprising:

a. a first insulation means for isolating said covering material from said structural members, said first insulation means being located between said structural members and said covering material and said first insulation means having a relatively low coefficient of thermal conductance;

b. a second insulation means in the form of a board-like sheet or layer of material, said second insulation means having at least one edge resting on a portion of at least one of said structural members and at least almost spanning the distance between two adjacent structural members, an opposite edge being at least near an adjacent structural member, said second insulation means having a relatively low coefficient of thermal conductance;

c. a third insulation means located between said second insulation means and said covering material, said third insulation means having a higher insulating value than said second insulation means; and d. a fourth insulation means fastened to most or all of the structural members, said fourth insulation means being of a configuration and location to completely insulate the structural member to which it is fastened from the interior of said building.

2. The system as defined in claim 1 wherein said fourth insulation means is located to also function as a support for one edge of said second insulation means.

3. The system as defined in claim 2 wherein said fourth insulation means comprises one or more strips of insulation material and a rigid means for holding the one or more strips of insulation material.

4. The system as defined in claim 3 wherein said second insulation means has an R-value of at least 5.

5. The system as defined in claim 4 wherein said third insulation means has an R-value of at least 19.

6. The insulation system as defined in claim 3 wherein said third insulation means comprises a first layer of insulation installed when the building was constructed and a second layer of insulation added later at the time that said third and fourth insulation means are provided.

7. A system as defined in claim 3 wherein said second insulation means comprises glass fibers bonded together to form a layer having a density of at least 2 PCF.

* * * * *